United States Patent [19]

Malagari, Jr.

[11] 4,054,470

[45] Oct. 18, 1977

[54] BORON AND COPPER BEARING SILICON STEEL AND PROCESSING THEREFORE

[75] Inventor: Frank A. Malagari, Jr., Freeport, Pa.

[73] Assignee: Allegheny Ludlum Industries, Inc., Pittsburgh, Pa.

[21] Appl. No.: 696,970

[22] Filed: June 17, 1976

[51] Int. Cl.[2] ..... H01F 1/04

[52] U.S. Cl. ..... 148/111; 148/31.55; 148/112; 75/123 L

[58] Field of Search ..... 148/110, 111, 112, 31.55; 75/123 L

[56] References Cited

U.S. PATENT DOCUMENTS

| | | | |
|---|---|---|---|
| 3,855,019 | 12/1974 | Salsgiver et al. | 148/112 |
| 3,873,380 | 3/1975 | Malagari | 148/111 |
| 3,905,843 | 9/1975 | Fiedler | 148/111 |

OTHER PUBLICATIONS

Kussmann, A. et al; Gekupferter Stahl...fur Transform; in Stahl und Eisen, 50 (June 1930) pp. 1194–1197.

*Primary Examiner*—Walter R. Satterfield

*Attorney, Agent, or Firm*—Vincent G. Gioia; Robert F. Dropkin

[57] ABSTRACT

A hot rolled band suitable for processing into cube-on-edge oriented silicon steel having a permeability of at least 1870 ($G/O_e$) at 10 oersteds and a core loss of no more than 0.700 watts per pound at 17 kilogauss; and processing for the steel from which the band is made. The hot rolled band has a thickness of from about 0.050 to about 0.120 inch; and consists essentially of, by weight, 0.02 to 0.06% carbon, 0.015 to 0.15% manganese, 0.01 to 0.05% of material from the group consisting of sulfur and selenium; 0.0006 to 0.0080% boron, up to 0.0100% nitrogen, 2.5 to 4.0% silicon, between 0.3 and 1.0% copper, no more than 0.008% aluminum, balance iron. Processing includes the steps of cold rolling the steel band to a thickness no greater than 0.020 inch without an intermediate anneal between cold rolling passes; preparing several coils from the steel; decarburizing the steel and final texture annealing the steel. Essential to the invention is the inclusion of a controlled amount of copper in the melt.

8 Claims, No Drawings

BORON AND COPPER BEARING SILICON STEEL AND PROCESSING THEREFORE

The present invention relates to an improvement in the manufacture of grain-oriented silicon steel.

Electromagnetic silicon steels, as with most items of commerce, command a price commensurate with their quality. Coils of steel from a particular heat are graded and sold according to grade. Coils with a particular core loss generally receive a lower grade than do coils with a lower core loss, all other factors being the same; and as a result thereof, command a lower selling price.

A number of recent U.S. Pat. Nos. (3,873,381; 3,905,842; 3,905,843 and 3,957,546) disclose that the quality of electromagnetic silicon steel can be improved by adding controlled amounts of boron to the melt. Steels having permeabilities of at least 1870 ($G/O_e$) at 10 oersteds and core losses of no more than 0.700 watts per pound at 17 kilogauss, have been achieved with said additions. However, as with most all processes, the processes described therein leave room for improvement. Through the present invention, there is described a process for improving the magnetic quality of individual coils of electromagnetic silicon steel; but even more significantly, a process wherein a heat of silicon steel can be processed so that at least 25%, and sometimes more than 50%, of the coils have a permeability of at least 1870 ($G/O_e$) at 10 oersteds and a core loss of no more than 0.700 watts per pound at 17 kilogauss. Basically, the present invention achieves its objective through controlled additions of copper.

As inferred in the preceding paragraph, meaningful additions of copper to the type of steel melts described in U.S. Pat. Nos. 3,873,381, 3,905,842, 3,905,843 and 3,957,546 is not known from the prior art. None of the four cited patents attribute any benefit to copper despite the fact that three of them specify copper contents in their examples; and, moreover, none of them disclose copper additions as high as the minimum specified herein. Likewise, U.S. Pat. Nos. 3,855,018, 3,855,019, 3,855,020, 3,855,021, 3,925,115, 3,929,522 and 3,873,380 fail to render the present invention evident. Although these patents disclose copper additions, they refer to dissimilar boron-free and/or aluminum-bearing steels. Moreover, neither they nor the other four references disclose a process of improving the magnetic quality of steel such that at least 25% of the coils of a particular single stage cold rolled heat have a permeability of at least 1870 ($G/O_e$) at 10 oersteds and a core loss of no more than 0.700 watts per pound at 17 kilogauss.

It is accordingly an object of the present invention to provide an improvement in the manufacture of grain-oriented silicon steel.

In accordance with the present invention a melt of silicon steel containing from 0.02 to 0.06% carbon, from 0.0006 to 0.0080% boron, up to 0.0100% nitrogen, no more than 0.008% aluminum, between 0.3 and 1.0% copper and from 2.5 to 4.0% silicon, is subjected to the conventional steps of casting, hot rolling to an intermediate thickness of from about 0.050 to about 0.120 inch, coil preparation, cold rolling to a thickness no greater than 0.020 inch without an intermediate anneal between cold rolling passes decarburizing and final texture annealing. Specific processing as to the conventional steps can be in accordance with that specified in the patents cited hereinabove. Moreover, the term casting is intended to include continuous casting processes. A hot rolled band heat treatment is also includable within the scope of the present invention. Melts consisting essentially of, by weight, 0.02 to 0.06% carbon, 0.015 to 0.15% manganese, 0.01 to 0.05% of material from the group consisting of sulfur and selenium, 0.0006 to 0.0080% boron, up to 0.0100% nitrogen, 2.5 to 4.0% silicon, between 0.3 and 1.0% copper, no more than 0.008% aluminum, balance iron, have proven to be particularly adaptable to the subject invention. The copper within the melt improves the magnetic quality of the steel such that at lest 25%, and sometimes more than 50%, of the coils have a permeability of at least 1870 ($G/O_e$) at 10 oersteds and a core loss of no more than 0.700 watts per pound at 17 kilogauss, at both ends. Boron levels are usually in excess of 0.0008%.

Although it is not definitely known why copper is beneficial, it is hypothesized that copper forms sulfide particles which act as an inhibitor; thereby improving magnetic properties through an advantageous affect on secondary recrystallization and grain growth. In addition, it is hypothesized that copper decreases the sensitivity of the alloy to hot working temperatures, and thereby increases the uniformity of the magentic quality between individual coils and coil ends.

Also includable as part of the subject invention is a hot rolled band suitable for processing into cube-on-edge oriented silicon steel having a permeability of at least 1870 ($G/O_e$) at 10 oersteds and a core loss of no more than 0.700 watts per pound at 17 kilogauss. The hot rolled band has a thickness of from about 0.050 to about 0.120 inch; and, consists essentially of, by weight, 0.02 to 0.06% carbon, 0.015 to 0.15% manganese, 0.01 to 0.05% of material from the group consisting of sulfur and selenium, 0.0006 to 0.0080% boron, up to 0.0100% nitrogen, 2.5 to 4.0% silicon, between 0.3 and 1.0% copper, no more than 0.008% aluminum, balance iron.

The following examples are illustrative of several aspect of the invention.

Three heats (Heats A, B and C) were melted and processed into coils of silicon steel having a cube-on-edge orientation. The chemistry of the heats appears hereinbelow in Table I.

TABLE I.

| | Composition (wt. %) | | | | | | | | |
|---|---|---|---|---|---|---|---|---|---|
| Heat | C | Mn | S | B | N | Si | Cu | Al | Fe |
| A | 0.029 | 0.040 | 0.020 | 0.0013 | 0.0048 | 3.13 | 0.27 | 0.003 | Bal. |
| B | 0.033 | 0.040 | 0.021 | 0.0014 | 0.0046 | 3.14 | 0.38 | 0.003 | Bal. |
| C | 0.031 | 0.041 | 0.020 | 0.0013 | 0.0046 | 3.13 | 0.50 | 0.004 | Bal. |

From Table I it is evident that the only significant variation in the chemistry of the heats is in their copper content. Heat A has a copper content of 0.27% whereas the copper contents of Heats B and C are respectively 0.38 and 0.50%.

Processing for the heats involved soaking at an elevated temperature for several hours, hot rolling to a nominal gage of 0.080 inch, coil preparation, hot roll band normalizing at a temperature of approximately 1740° F, cold rolling to final gage, decarburizing at a temperature of approximately 1475° F, and final texture annealing at a maximum temperature of 2150° F in hydrogen.

Coils from Heats A, B and C were measured for gage and tested for permeability and core loss. The results of the tests appear hereinbelow in Table II.

TABLE II.

| Heat | Cu(%) | Coil No. | Gage (mils) | Core Loss (WPP at 17KB) | Permeability (at 10 $O_3$) |
|---|---|---|---|---|---|
| A | 0.27 | 1 In | 12.6 | 0.706 | 1918 |
| | | Out | 9.5 | 0.645 | 1941 |
| | | 2 In | 11.8 | 0.732 | 1901 |
| | | Out | 12.3 | 0.712 | 1922 |
| | | 3 In | 11.8 | 0.764 | 1865 |
| | | Out* | | | |
| | | 4 In | 10.7 | 0.657 | 1896 |
| | | Out | 11.4 | 0.703 | 1913 |
| | | 5 In | 11.6 | 0.678 | 1920 |
| | | Out | 10.8 | 0.674 | 1901 |
| | | 6 In | 12.2 | 0.698 | 1903 |
| | | Out | 1.3 | 0.704 | 1897 |
| | | 7 In | 12.1 | 0.766 | 1881 |
| | | Out | 11.2 | 0.705 | 1892 |
| B | 0.38 | 1 In | 11.5 | 0.685 | 1915 |
| | | Out | 11.5 | 0.658 | 1914 |
| | | 2 In | 11.0 | 0.667 | 1904 |
| | | Out | 11.3 | 0.715 | 1880 |
| | | 3 In* | — | — | — |
| | | Out | 10.5 | 0.663 | 1901 |
| | | 4 In | 11.6 | 0.698 | 1890 |
| | | Out | 11.1 | 0.674 | 1912 |
| | | 5 In | 12.0 | 0.748 | 1878 |
| | | Out* | — | — | — |
| | | 6 In | 11.6 | 0.709 | 1886 |
| | | Out | 11.2 | 0.667 | 1910 |
| | | 8 In | 11.4 | 0.667 | 1910 |
| | | Out | 10.7 | 0.680 | 1890 |
| C | 0.50 | 1 In | 11.7 | 0.684 | 1910 |
| | | Out | 11.1 | 0.657 | 1911 |
| | | 2 In | 11.3 | 0.685 | 1910 |
| | | Out | 10.8 | 0.655 | 1920 |
| | | 3 In | 11.2 | 0.687 | 1904 |
| | | Out | 11.1 | 0.665 | 1925 |
| | | 4 In | 12.4 | 0.715 | 1891 |
| | | Out | 12.2 | 0.696 | 1910 |
| | | 5 In | 11.6 | 0.679 | 1912 |
| | | Out | 11.2 | 0.678 | 1916 |
| | | 6 In | 11.6 | 0.701 | 1903 |
| | | Out | 10.3 | 0.698 | 1872 |
| | | 7 In | 11.5 | 0.684 | 1894 |
| | | Out | 10.9 | 0.668 | 1913 |
| | | 8 In | 11.2 | 0.679 | 1909 |
| | | Out | 10.5 | 0.644 | 1922 |

*Heavy Gage

From Table II it is clear that only one of the coils from Heat A had at both ends a permeability of at least 1870 ($G/O_e$) at 10 oersteds and a core loss of no more than 0.700 watts per pound at 17 kilogauss. Significantly, Heat A has a copper content of 0.27%; a level below the minimum of the present invention. On the other hand three coils from Heat B and six coils from Heat C had magnetic properties exceeding those specified. Significantly, Heats B and C have copper contents within the subject invention; respectively 0.38 and 0.50%. Moreover, more than 50% of the coils from Heat C exceeded the specified properties. Such data indicates that copper contents in excess of 0.5% should be most beneficial.

It will be apparent to those skilled in the art that the novel principles of the invention disclosed herein in connection with specific examples thereof will suggest various other modifications and applications of the same. It is accordingly desired that in construing the breadth of the appended claims they shall not be limited to the specific examples of the invention described herein.

I claim:

1. In a process for producing electromagnetic silicon steel having a cube-on-edge orientation, which process includes the steps of: preparing a melt of silicon steel containing from 0.02 to 0.06% carbon, from 0.015 to 0.15% manganese, from 0.01 to 0.05% of material from the group consisting of sulfur and selenium, from 0.0006 to 0.0080% boron, up to 0.0100% nitrogen, no more than 0.008% aluminum and from 2.5 to 4.0% silicon; casting said steel; hot rolling said steel to an intermediate thickness of from about 0.050 to about 0.120 inch; cold rolling said steel from said intermediate thickness to a final gage no greater than 0.020 inch without an intermediate anneal between cold rolling passes; preparing several coils from said steel; decarburizing said steel; and final texture annealing said steel; the improvement comprising the step of incorporating between 0.3 and 1.0% copper in said melt, said copper improving the magnetic quality of said steel so that at least 25% of said coils have a permeability of at least 1870 ($G/O_e$) at 10 oersteds and a core loss of no more than 0.700 watts per pound at 17 kilogauss, at both ends, said melt consisting essentially of, by weight, from 0.02 to 0.06% carbon, from 0.015 to 0.15% manganese, from 0.01 to 0.05% of material from the group consisting of sulfur and selenium, from 0.0006 to 0.0080% boron, up to 0.0100% nitrogen, no more than 0.008% aluminum, from 2.5 to 4.0% silicon, between 0.3 and 1.0% copper, balance iron.

2. The improvement according to claim 1, wherein said melt has at least 0.0008% boron.

3. The improvement according to claim 2, wherein an amount of copper in excess of 0.5% is added to the melt.

4. The improvement according to claim 2, wherein at least 50% of said coils have a permeability of at least 1870 ($G/O_e$) at 10 oersteds and a core loss of no more than 0.700 watts per pound at 17 kilogauss, at both ends.

5. A cube-on-edge oriented silicon steel having a permeability of at least 1870 ($G/O_e$) at 10 oersteds and a core loss of no more than 0.700 watts per pound at 17 kilogauss, and made in accordance with the process of claim 2.

6. A hot rolled band for processing into cube-on-edge oriented silicon steel having a permeability of at least 1870 ($G/O_e$) at 10 oersteds and a core loss of no more than 0.700 watts per pound at 17 kilogauss; said hot rolled band having a thickness of from about 0.050 to about 0.120 inch; said hot rolled band consisting essentially of, by weight, 0.02 to 0.06% carbon, 0.015 to 0.15% manganese, 0.01 to 0.05% of material from the group consisting of sulfur and selenium, 0.0006 to 0.0080% boron, up to 0.0100% nitrogen, 2.5 to 4.0% silicon, between 0.3 and 1.0% copper, no more than 0.008% aluminum, balance iron.

7. A hot rolled band according to claim 6, having at least 0.0008% boron.

8. A hot rolled band according to claim 7, having in excess of 0.5% copper.

* * * * *